US005257435A

United States Patent [19]

Brewster

[11] Patent Number: 5,257,435

[45] Date of Patent: Nov. 2, 1993

[54] CHIMNEY CLEANING TOOL

[76] Inventor: John S. Brewster, 10 Stowell Rd., North Grafton, Mass. 01536

[21] Appl. No.: 842,904

[22] Filed: Feb. 27, 1992

[51] Int. Cl.[5] ..... A47L 13/02; A46B 13/02

[52] U.S. Cl. ..... 15/179; 15/1; 15/92; 15/104.095; 15/162; 15/236.01; 15/242

[58] Field of Search ..... 15/162, 163, 242, 243, 15/249, 179, 200, 54, 55, 104.095, 1, 89, 90, 92, 236.1

[56] References Cited

U.S. PATENT DOCUMENTS

| | | | |
|---|---|---|---|
| 860,579 | 7/1907 | Sholdebrand | 15/249 |
| 1,126,961 | 2/1915 | Denny . | |
| 1,338,917 | 5/1920 | Hall . | |
| 1,685,380 | 9/1928 | Schultz . | |
| 1,917,383 | 7/1933 | McCarthy . | |
| 2,599,077 | 6/1952 | Sturgis . | |
| 2,763,257 | 9/1956 | Asbury | 15/200 |
| 3,120,020 | 2/1964 | Schell . | |
| 3,381,754 | 5/1968 | Tompkins . | |
| 4,454,625 | 6/1984 | Kern . | |
| 4,534,080 | 8/1985 | Young . | |

FOREIGN PATENT DOCUMENTS

| | | | |
|---|---|---|---|
| 2155733 | 5/1973 | Fed. Rep. of Germany | 15/243 |
| 237965 | 8/1925 | United Kingdom | 15/200 |

*Primary Examiner*—Harvey C. Hornsby
*Assistant Examiner*—Randall E. Chin
*Attorney, Agent, or Firm*—Alex Rhodes

[57] ABSTRACT

A chimney cleaning tool for removing accumulations of foreign materials from the interior surfaces of smoke chambers and chimney flues of fireplaces and furnaces. The invention comprises a hub which is adapted to be rotated by a power driven rod, a single resilient multi-wire cable clamped to the hub and U-bolts with hex nuts for clamping the cable to the hub. The cable has loop shaped portions arranged in perpendicular relationship to the rotational axis of the hub which extend outwardly from the hub. When the tool is inserted into a chimney flue, rotated, and brought to bear against the interior surfaces of the flue, the outer portions of loops rapidly remove accumulated materials from the flue without damaging the flue. The invention can also be used for removing materials which accumulate on the walls of other conduits, such as sewers and oil well casings.

10 Claims, 2 Drawing Sheets

CHIMNEY CLEANING TOOL

BACKGROUND OF THE INVENTION

This invention relates to tools for cleaning conduits and more particularly for removing accumulations of foreign materials on the interior surfaces of smoke chambers and chimney flues of fireplaces and furnaces.

Most chimneys are lined with clay tile liners, commonly referred to as flues. The purpose of the flues is to reduce the amount of heat transfer from the gases passing through the chimney to adjacent structures of buildings. The products of combustion, such as soot, resin and creosote accumulate on the interior surfaces of fireplace smoke chambers and chimney flues. Heat causes these products to become glazed and hardened, making their removal difficult. If large amounts are allowed to build-up on surfaces, they can ignite and cause fires.

In the past, many chemical and mechanical products have been developed for cleaning smoke chambers and chimney flues. Some of these products have been power driven rotary devices which are thrown outwardly by great centrifugal force to scrape accumulated materials from smoke chambers and flues. Others have been power driven rotary wire brushes.

The power driven devices which exert high forces have been unsuccessful because of physical damage to clay tile flues. Power driven wire brushes alone have been incapable of removing the glazed and hardened materials. The most effective method has been to chemically treat the smoke chambers and flues and follow-up with power driven wire brushes. This method is time consuming and expensive.

A power driven rotary cleaning tool which could remove accumulations of foreign materials from fireplace smoke chambers and chimney flues without damaging the flues would reduce the time and cost over the current method.

SUMMARY OF THE INVENTION

The present invention satisfies the foregoing need by providing a power driven tool which rapidly removes accumulated materials without damaging chimney flues. The invention comprises a hub which is adapted to be rotated by a power driven rod, a single resilient multi-wire cable clamped to the hub and U-bolts with hex nuts for clamping the cable to the hub. The cable has outward extending loop-shaped portions arranged in perpendicular relationship to the rotational axis of the hub.

One benefit of my invention is that deposits can be removed from the interior surfaces of a flue without pre-treating the flue with chemicals. Moreover, when the tool is inserted into a chimney flue, rotated and brought to bear against the interior surfaces of the flue, the outer portions of loops rapidly remove accumulated materials without damaging the flue. Another benefit of my invention is that it can also be used for removing deposits which accumulate o the walls of other conduits, such as sewers and oil well casings.

The foregoing features and benefits of my invention, together with other features and benefits, will be apparent from the ensuing detailed description taken in conjunction with the accompanying drawings. The best mode which is contemplated in practicing my invention is disclosed and the subject matter in which exclusive property rights are claimed is set forth in each of the numbered claims which are appended to the detailed description.

DETAILED DESCRIPTION OF THE PREFERRED EMBODIMENT

Figure 1:
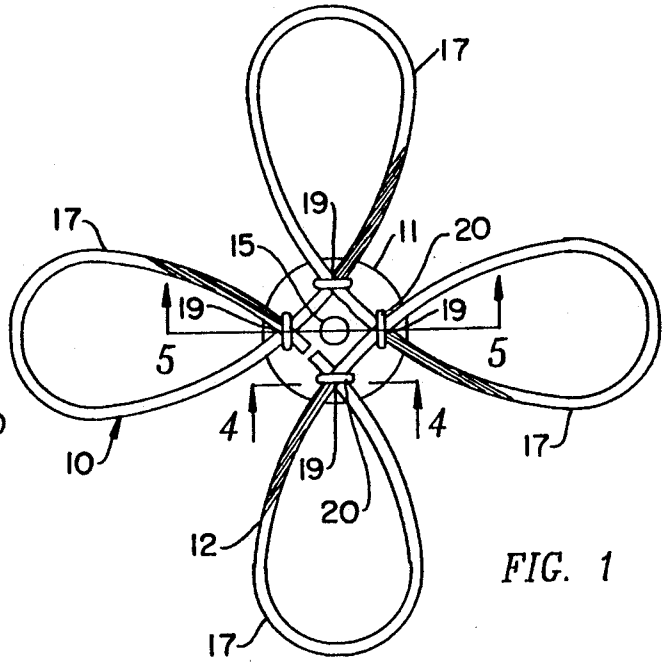
FIG. 1 is a front view of a chimney cleaning tool which embodies the present invention.
Figure 2:
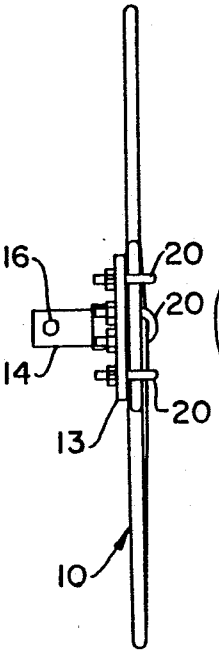
FIG. 2 is a side elevational view of the chimney cleaning tool.
Figure 3:
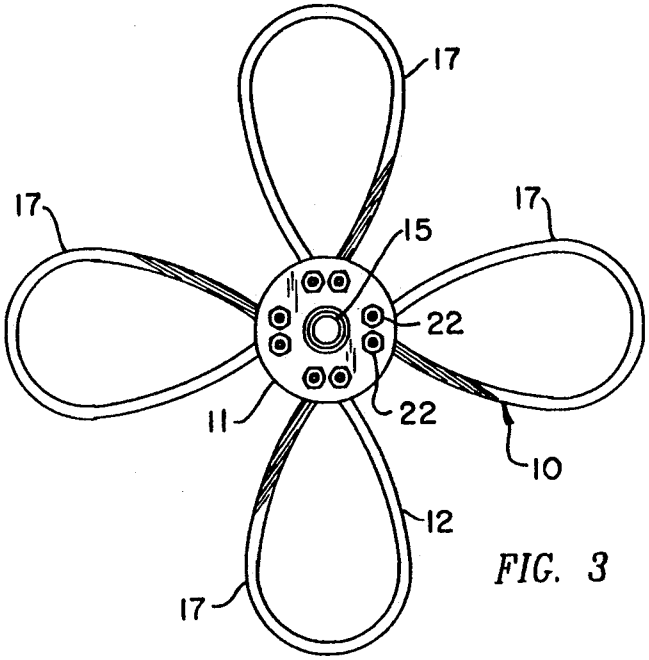
FIG. 3 is a rear view of the chimney cleaning tool.
Figure 4:
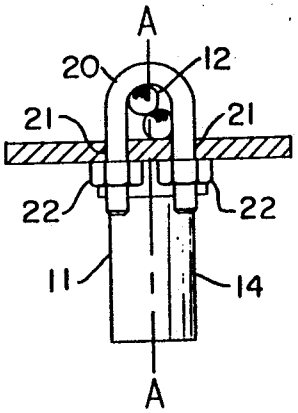
FIG. 4 is a cross-sectional view drawn to an enlarged scale taken on the line 4—4 of FIG. 1.
Figure 5:
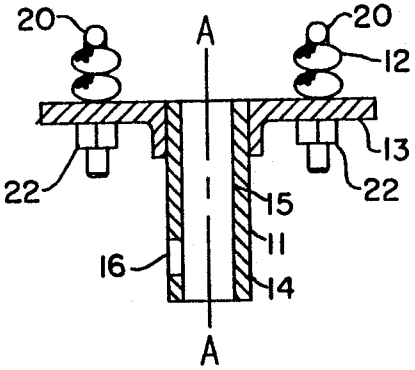
FIG. 5 is a cross-sectional view drawn to an enlarged scale, taken on the line 5—5 of FIG. 1.

Referring now to the drawings wherein like numerals designate like and corresponding parts throughout the several views, in FIGS. 1 through 5, inclusive, a chimney cleaning tool 10 is shown for purposes of illustration which embodies my invention.

The chimney cleaning tool 10 is comprised of a cylindrical hub 11 and a stiff resilient cable 12 which is clamped to the hub 11. The hub 11 is adapted to be mounted on a rod which is rotatably driven by an existing power tool, such as a hand held electric drill. The hub 11 has a circular flange 13 and tubular member 14 which is attached to the flange 13 by welding or some other standard method such as a threaded connection. An aperture 15 extends through the center of the hub 11. The aperture 15 is sized to fit an end portion of a rod which is connected to a power tool (not shown). In the tubular member 14 there is a transverse aperture 16 for fixing the hub 11 to the rod.

The cable 12 is comprised of a plurality of small diameter high strength steel wires helical wound to provide a durable stiff resilient cable 12. With reference to FIG. 1, the cable 12 has four loops 17 which lie in a plane that is perpendicular to the rotational axis A—A of the hub 11 and extend outwardly from the hub 11. The loops 17 are preferably spaced at equal angles about the rotational axis A—A of the hub 11.

With reference to FIG. 1, the loops 17 are formed by crossing over portions of the cable 12. At the cross-over portions 19 there are U-bolts 20 which straddle the cross-over portions 19 and extend through apertures 21 in the flange 13. On the opposite side of the flange 13 there are hex nuts 22 which threadably engage the ends of the U-bolts 20 to tightly clamp the cable 12 to the flange 13.

Thus, it is seen that one feature of my invention is that the loops 17 are formed in the single cable 12 by crossing over portions 19 of the cable 12 and interconnecting the loops 17 with each other.

Figure 6:
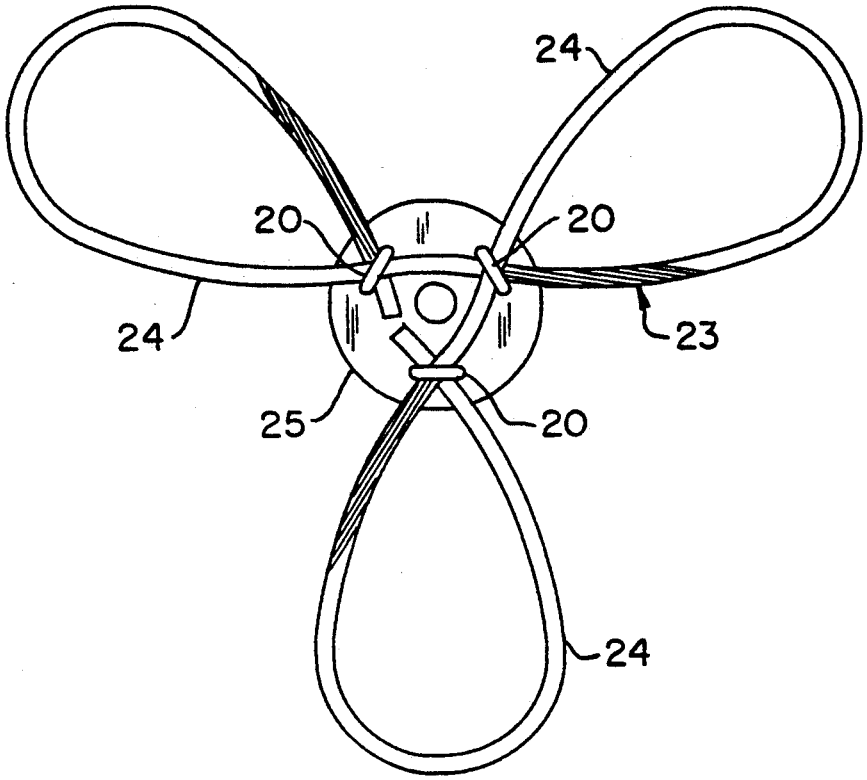
FIG. 6 is a front view of an alternate embodiment of the invention.
Figure 7:
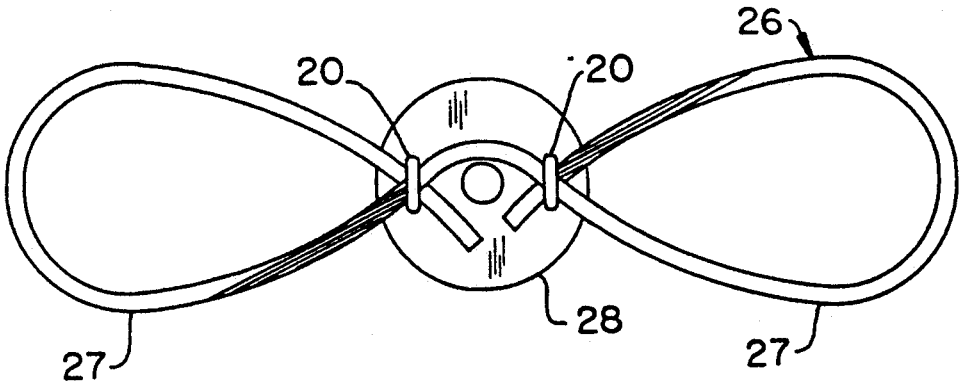
FIG. 7 is a front view of a second alternate embodiment.

Although a tool 10 with a cable 12 having four loops 17 has been illustrated in FIGS. 1 through 5 and described, it is not my intention to limit my invention to four loops 17. By way of illustration, in FIG. 6 an alternate embodiment 23 is shown having three loops 24 spaced apart at equal angles about the axis of a hub 25 and clamped to the hub 25 with U-bolts 20 and hex nuts 22. In FIG. 7 is shown yet another embodiment 26 having two loops 27 spaced apart at equal angles about the axis of a hub 28 and clamped to the hub with U-bolts 20 and hex nuts 22.

The manner of using my invention is as follows. The cleaning tool 10 is attached to the end of a rod which is connected to a power hand tool. The cleaning tool 10 is inserted into a fireplace smoke chamber or chimney flue and moved laterally and axially to engage the outer portions of the loops with the interior surfaces of the smoke chamber or flue. The rotation of the tool 10 removes the unwanted accumulated materials from the smoke chamber or flue.

From the foregoing it will be appreciated that my invention provides a chimney cleaning tool which is effective for removing inflammable materials which accumulate on the walls of fireplace smoke chambers and chimney flues. Moreover, the materials are removed without damaging the clay tile flues in the interiors of the chimneys.

Although only several embodiments have been illustrated and described, it will be understood that other embodiments can be developed without departing from the spirit thereof.

I claim:

1. An apparatus for removing deposits from the inner surfaces of a conduit comprising: a hub which is adapted to be rotated about an axis by a power source, the rotational axis of said hub defining an axis of reference; a cleaning member for removing deposits from the inner surfaces of a conduit, said cleaning member comprising a continuous slender stiff resilient cable attached to said hub, said cable having a plurality of closed loop-shaped portions extending radially outwardly from said hub, said loop-shaped portions being arranged at equal angles about said reference axis in a direction which is substantially perpendicular to said reference axis; and a means for attaching each end of said loop-shaped portion to said hub.

2. The conduit cleaning apparatus recited in claim 1 further comprising said cable having two loop-shaped portions extending radially outwardly from said hub at equal angles about said reference axis in a direction which is substantially perpendicular to said reference axis.

3. The conduit cleaning apparatus recited in claim 1 further comprising said cable having more than two loop-shaped portions extending radially outwardly from said hub at equal angles about said reference axis in a direction which is substantially perpendicular to said reference axis.

4. The conduit cleaning apparatus recited in claim 1 further comprising said cable having more than four loop-shaped portions extending radially outwardly from said hub at equal angles about said reference axis in a direction which is substantially perpendicular to said reference axis.

5. The conduit cleaning apparatus recited in claim 1 further comprising said cleaning member being a unitary member.

6. The conduit cleaning apparatus recited in claim 5 further comprising said unitary member being formed of a plurality of stiff resilient wires.

7. The conduit cleaning apparatus recited in claim 1 wherein said means for attaching said cable to said hub comprises a pair of U-shaped fasteners for clamping each of said loop-shaped portions to said hub.

8. The conduit cleaning apparatus recited in claim 1 wherein said cleaning member is comprised of four-loop shaped portions.

9. In an apparatus for removing deposits from the inner surfaces of a conduit having a slender stiff resilient cable formed from a plurality of wires and a means for rotating said cable about an axis of a conduit to remove deposits from said conduit by said cable contacting said inner surfaces of said conduit, the improvement which comprises said cable having four closed loop-shaped portions disposed in a direction which is substantially perpendicular to the rotational axis of said conduit, said loop-shaped portions of said cable being arranged at equal angles about said rotational axis of said cable; and a means for attaching each end of said loop-shaped portion to said means for rotating said cable.

10. An apparatus for removing deposits from the inner surfaces of a conduit comprising: a hub which is adapted to be rotated about an axis by a power source, the rotational axis of said hub defining an axis of reference; a cleaning member for removing deposits from the inner surfaces of a conduit, said cleaning member comprising a slender stiff resilient cable formed of a plurality of stiff resilient wires, said cable attached to said hub and having a plurality of closed loop-shaped portions extending radially outwardly from said hub, said loop-shaped portions being arranged at equal angles about said reference axis in a direction which is substantially perpendicular to said reference axis; and a means for clamping each end of said loop-shaped portion to said hub.

* * * * *